United States Patent [19]

Masunaga et al.

[11] 4,069,165

[45] Jan. 17, 1978

[54] ELECTRICAL INSULATING OILS

[75] Inventors: Midori Masunaga, Tokyo; Yoshiki Kohno, Kawasaki; Kohji Hayashi, Yokohama, all of Japan

[73] Assignee: Nippon Oil Company, Ltd., Tokyo, Japan

[21] Appl. No.: 672,375

[22] Filed: Mar. 31, 1976

[30] Foreign Application Priority Data

Apr. 9, 1975 Japan ..... 50-42232

[51] Int. Cl.[2] ..... H01B 3/22

[52] U.S. Cl. ..... 252/63; 208/14; 208/19; 252/73

[58] Field of Search ..... 208/14, 19; 252/63

[56] References Cited

U.S. PATENT DOCUMENTS

| | | | |
|---|---|---|---|
| 2,787,582 | 4/1957 | Watkins | 208/58 |
| 2,810,769 | 10/1957 | Sanford et al. | 252/63 |
| 3,036,010 | 5/1962 | Freier | 252/63 |
| 3,549,537 | 12/1970 | Brewster et al. | 208/14 |
| 3,627,673 | 12/1971 | Sproule et al. | 208/211 |
| 3,673,093 | 6/1972 | Rocchi | 252/63 |

*Primary Examiner*—Herbert Levine
*Attorney, Agent, or Firm*—Frank J. Jordan

[57] ABSTRACT

An electrical insulating oil consisting essentially of (1) a mineral oil, as the base oil for the product oil, containing not more than 0.35 wt.% of sulphur and being prepared by refining a distillate containing at least 80 wt.% of a fraction boiling at 230°–430° C at atmospheric pressure, the distillate being obtained by the distillation of paraffin or mixed base crude oils, (2) at least one arylalkane and, if desired, (3) a hydrocarbon-derived pour point depressant.

12 Claims, No Drawings

ELECTRICAL INSULATING OILS

This invention relates to electrical insulating oils essentially derived from paraffin base crude oils or mixed base crude oils. More particularly it relates to an electrical insulating oil having excellent thermal stability, resistance to copper plate discoloration, electrical properties, low-temperature properties such as low pour point, and corona resistance, which insulating oil consists essentially of (1) 50–97 parts by weight of a mineral oil containing not more than 0.35 wt.% of sulphur and being prepared by refining with a solvent and/or hydrofining a distillate containing at least 80 wt.% of a fraction having a boiling range of 230°–430° C at atmospheric pressure, the distillate being obtained by the distillation of a paraffin or mixed base crude oil, and then dewaxing the thus refined distillate with a solvent, (2) 3–50 parts by weight of at least one arylakane and, if desired, (3) 0.001–1.0 part by weight of a hydrocarbon-derived pour point depressant.

All "part" or "parts" hereinafter described are by weight unless otherwise specified.

Various insulating oils have heretofore been marketed, and the quantitatively greater part thereof has been of a mineral oil type. The reason for this is that as compared with insulating oils obtained by synthesis, mineral oil type insulating oils may be supplied at a relatively low cost and in large amounts since they are prepared from petroleum fractions as the principal starting material therefor. The synthetic insulating oils have partly been limited in certain particular uses.

On the other hand, the conventional mineral oil type insulating oils are not such that all of them may be produced from any crude oils without substantial difference in quality therebetween as is the case with gasoline or kerosene. In practice, in order to produce a mineral oil type insulating oil, it is the most important to select a crude oil for the insulating oil; more particularly there have practically been needed, as the crude oils, naphthene base crude oils which have a certain range of specific gravity, flash point and viscosity as well as a low freezing point and a low sulphur content.

On the other hand, medium-and small-sized transformers have recently been desired to be made in a further small-sized and light-weight form and, therefore, there have been designed new transformers of a 65° C rise type which may be used at temperatures 10° C higher than those at which conventional transformers are used. Therefore, there have come to be demanded insulating materials which may satisfactorily be used at such higher temperatures. Conventional insulating paper and a naphthene base crude oil-derived mineral oil when used alone will not have a sufficiently long life as an insulating material at such high temperatures. Recently, condensers and cables as well as transformers and breakers are thoroughly degased prior to being charged with an insulating oil, after which they are further treated so that they are substantially prevented from contacting air by the use of diaphrams or nitrogen enclosure; therefore, there are very few cases where oxygen is present in said electrical appliances. There have thus been generally desired to be obtained electrical insulating oils which are required to have oxidation stability heretofore made much of and are more highly required to be excellent in thermal stability as determined from variation in tan $\delta$ at the time of thermal degradation of the insulating oils.

The present inventors had made intensive studies in attempts to obtain electrical insulating oils having such excellent thermal stability at a relatively low cost and in quantities and, as a result, they have found that very excellent electrical insulating oils may surprisingly be produced by incorporating (1) a mineral oil obtained by a predetermined refinement of a specific distillate from the paraffin or mixed base crude oil, with (2) arylalkanes in specific amounts or with (2) arylalkanes and (3) a hydrocarbon-derived pour point depressant each in specific amounts.

On the other hand, since the so-called petroleum panic it has been extremely difficult to obtain naphthene base crude oils which are naturally occurring only in the limited areas and in small amounts. It has thus been expected to obtain electrical insulating oils from mixed or paraffin base crude oils which are available at a relatively low cost and in quantities, and, as will be seen from this invention, it is considered very significant to obtain excellent electrical insulating oils from paraffin or mixed base crude oils.

There has already been known an electrical insulating oil improved in hydrogen gas absorbency by blending a naphthene base crude oil-derived mineral oil with an alkylbenzene (U.S. Pat. No. 3,036,010). As is indicated in Comparative examples to be described later, however, electrical insulating oils consisting mainly of such a naphthene base crude oil-derived mineral oil are not fully satisfactory in thermal stability.

In addition, it has already been known that synthetic oils such as alkylbenzenes are used as electrical insulating oils "Sekiyu Gakkai Shi (Journal of Petroleum Academic Society)", No. 7, Vol. 17, 1974; however, they are very inferior in oxidation stability and the like and may be used only in a specific insulating oil such as a cable oil. Furthermore, these synthetic oils are considerably expensive and are very often difficult to supply in large quantities. It is therefore necessary to produce and supply electrical insulating oils at a relatively low cost and in large quantities.

An object of this invention is to provide new electrical insulating oils having more excellent thermal stability and high-temperature stability than conventional ones derived from naphthene base crude oils and having substantially the same corona resistance and low-temperature properties (such as low pour point) as said conventional ones, the new electrical insulating oils being produced by incorporating with a predetermined amount of at least one arylalkane a base oil (for the electrical insulating oils) obtained from paraffin or mixed base crude oils by the use of a specific process.

Another object of this invention is to provide such new electrical insulating oils having particularly excellent low-temperature properties (such as low pour point) produced by adding a specific amount of each of at least one arylalkane and a hydrocarbon-derived pour point depressant to the base oil for the electrical insulating oils.

These and other objects will be apparent from the following description.

The paraffin base crude oil used herein is one containing paraffinic hydrocarbons in large proportions and more particularly the crude oil is such that its first key fraction (kerosene fraction) has an API specific gravity of not smaller than 40° and its second key fraction (lubricating oil fraction boiling at 275°–300° C at a reduced pressure of 40mm of mercury) has an API specific gravity of not smaller than 30° as is described in "Sekiyu Binran (handbook of Petroleum)" on page 19, 1972 edition, published by Sekiya Shunju Co., Ltd., Japan; Typical of the paraffin base crude oils are a Pennsylvania crude oil, a Minas crude oil and the like.

The mixed base crude oil used herein is one which is qualitatively intermediate between the paraffin and a naphthene base crude oil and more particularly the mixed base crude oil is such that its frist key fraction has an API specific gravity of 33°–40° and its second key fraction an API specific gravity of 20°–30° . Typical of the mixed base crude oils are Midcontinent crude oil and many of Middle East-produced crude oils such as Arabia and Khafji crude oils. In this invention there may preferably be used in the Arabia crude oils such as Arabian medium and Arabian light crude oils.

In this invention, a distillate containing at least about 80 wt.%, preferably at least about 90 wt.%, of a fraction having a boiling range of 230°–430° C at atmospheric pressure, the distillate being obtained either by distilling the paraffin or mixed base crude oils at atmospheric pressure or by distilling at a reduced pressure a bottom oil obtained by the distillation of the crude oil at atmospheric pressure, is treated with a solvent capable of selective dissolution of aromatic compounds to obtain the base oil (1).

The solvents for selectively dissolving the aromatic compounds are usual ones illustrated by furfural, liquefied sulphur dioxide, phenol and the like; among these solvents furfural is particularly preferred. When furfural, for example, is used as the solvent, the extracting temperatures used may be in the range of usually 50°–100° C, preferably 60°–90° C, and the ratios by volume of furfural to the distillate for the base oil (1) may be in the range of 0.3 or more, preferably 0.5 or more.

In addition, said distillate having been hydrofined (or refined by hydrogenation) may also be used in the production of electrical insulating oils of this invention.

The catalysts which may be used in the hydrofining according to this invention include the oxides of metals of Group VI, Group IB and Group VIII of the Periodic Table, the metal oxides being supported by bauxite, activated carbon, Fuller's earth, diatomaceous earth, zeolite, alumina, silica, silica alumina or the like, as the carrier. These catalyst are usually used after preliminary sulphurization of the catalytic metal portion on the carrier portion. Typical of the metal oxides are cobalt oxide, molybdenum oxide, tungsten oxide and nickel oxide.

In the practice of this invention there may particularly preferably be used a catalyst consisting of nickel and molybdenum oxides supported on an aluminum oxide-containing carrier, the metal oxides having been preliminarily sulphurized. The reaction temperatures in the hydrofining treatment may usually be in the range of about 230°– about 350° C, preferably about 260°–about 320° C. At lower reaction temperatures the reaction rate will be low, while at higher temperatures the oil to be treated will be decomposed whereby the paraffin content is increased, the pour point is somewhat raised and the electrical insulating oil is not desirable in color. The reaction pressures may be at least 25 $Kg/cm^2$, preferably 25–100 $Kg/cm^2$ and more preferably 35–45 $Kg/cm^2$. In addition, the amounts of hydrogen contacted with the oil to be hydrofined may be 100–10,000 $Nm^3/Kl$ of oil, preferably 200–1,000 $Nm^3/Kl$ of oil.

In this invention, as mentioned above, either one of the refinement with the solvent and the refinement with hydrogen (hydrofining) may be used; however, the use of both of the refinements is preferred in view of the fact that the resulting electrical insulating oil may have an improved thermal stability in this case. To this end, the distillate for the base oil (1) is usually refined with the solvent to an extent that 30–85 wt.%, preferably 30–75 wt.% of the sulphur content of the distillate is desulphurized. The order in which the solvent refinement and the hydrofining are carried out is not limited; however, it is particularly preferable that firstly the distillate is refined with the solvent thereby obtaining a raffinate and secondly the raffinate so obtained is hydrofined.

According to this invention, the raffinate so hydrofined is further subjected to dewaxing treatment with a suitable solvent. The solvent dewaxing is effected by the use of a known method to solidify the waxy material contained in the hydrofined raffinate thereby removing the thus-solidified waxy material from the raffinate. The known method usually employed is the BK method. The solvents used herein include a mixed solvent such as benzene-toluene-acetone or benzene-toluene-methyl ethyl ketone. The suitable composition (ratio of ketonic component to aromatic components) of the solvent is about 30–35% for acetone-containing mixed solvents and about 45–50% for methyl ethyl ketone-containing ones.

The ratios of the solvent to the oil being dewaxed may be such that the solvent-added oil fed to a dewaxing filter is kept approximately constant in viscosity.

The solvent dewaxing treatment according to this invention may be carried out at any stage prior to or subsequent to the solvent refining treatment and/or the hydrofining treatment, but it may preferably be carried out subsequent to the solvent refinement and/or the hydrofining to further increase the dewaxing efficiency. If necessary, the thus dewaxed oil may successively be treated with a solid adsorbent. The solid adsorbent treatment stated herein is intended to mean a treatment by which a mineral oil being treated is contacted with a solid adsorbent such as acid clay, activated clay, Fuller's earth, alumina or silica alumina. The contact is usually effected at about 30°–80° C. This treatment with the adsorbent will further increase the resulting insulating oil in thermal stability, electrical properties and the like.

According to this invention, it is necessary to obtain the base oil (1) having a decreased sulphur content of not higher than 0.35 wt.%, preferably 0.01–0.2 wt.%. If a base oil has a sulphur content of more than 0.35 wt.%, an electrical insulating oil containing the base oil will be inferior in "inertness to discoloration of copper plates" (or corrosion inertness) thereby having adverse effects on copper blackening in a vessel in which an electrical insulating oil is held.

The arylalkanes which may be used in this invention are alkylbenzenes represented by the following general formula

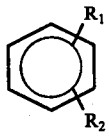

wherein $R_1$ and $R_2$ are each hydrogen or a hydrocarbon residue having 1–20carbon atoms, and the total number of carbon atoms contained in $R_1$ and $R_2$ is at least 9, preferably 12–28. The use of an arylalkane wherein the total number of carbon atoms of $R_1$ and $R_2$ is less than 9 will result in the production of an electrical insulating oil having an unsatisfactory flash point and properties as determined by a known test for distillation. The hydrocarbon radicals $R_1$ and $R_2$ may be in the form of a straight chain or branched chain. Furthermore, the aklylbenzenes used herein may contain one or more of tetralin, indene, indane and hydrocarbon derivatives thereof in amounts of not more than about 50% by weight.

These alkylbenzenes are usually obtained by condensing (alkylating) benzene with at least one olefin or by condensing benzene with at least one halogenated paraffin in the presence of an acid catalyst such as a Friedel-Crafts' type catalyst. As the alkylbenzenes used for industrial purposes, there mau preferably be used monoalkylbenzenes having about 9–16 carbon atoms obtained at the time of synthesis of straight chain or branched chain alkylbenzenes for use as detergents, heavy alkylbenzenes produced as by-products at the time of said synthesis, and bottom oils obtained by distilling off the alkylbenzenes for use as detergents. These arylalkanes may generally be hydrofined to improve themselves in electrical properties. As catalysts for this hydrofining, there may preferably be used those consisting of at least one member selected from metals of Groups IV, VII and VIII of the Periodic Table, and oxides and sulphides of said metals, said at least one member being preferably carried on silica, alumina, diatomaceous earth, activated carbon or the like. More specifically, preferable catalysts for the hydrofining include palladium, platinum, nickel, copper-chromium, cobalt-molybdenum, nickel-molybdenum and nickel-tungsten, these metals being carried on said carriers or not. The hydrofining reaction may be effected at a pressure of 2–50 $Kg/cm^2G$, a temperature of 50°–400° C and a LHSV (liquid hourly space velocity) of 1–15 vol./vol.

If straight chain, heavy alkylbenzenes having a boiling range of not lower than about 300° C are attempted to be used as the arylakanes, they should preferably be hydrofined, prior to their use, under such conditions as to selectively hydrogenate the polycyclic alkylaryl compounds contained therein whereby they are allowed to have visual absorbancy of $0.4 \times 10^{-3}$g/l·cm at a wavelength of 400 mμ of visible rays; the heavy alkylbenzenes treated to have such visual absorbency may particularly preferably be used.

In one embodiment of this invention, 3–50 parts of at least one of the arylalkanes may be added to 50–97 parts of the base oil (1) derived from the parrafin or mixed base crude oil to form the insulating oil of this invention. The addition of the arylalkane or arylalkanes in amounts of less than 3 parts will result in the production of an electrical insulating oil which is not sufficiently satisfactory in thermal stability, hydrogen gas absorbency and the like, while the addition thereof in amounts of more than 50 parts will result in the production of an insulating oil having little improved thermal stability, hydrogen gas absorbency and like properties at a high cost, this being uneconomical.

In another embodiment of this invention, 50–97 parts of the base oil (1) may be incorporated not only with 3–50 parts of the arylalkane or arylalkanes but also with 0.001–1.0 part, preferably 0.01–0.2 parts, of the hydrocarbon-derived pour point depressant to produce the insulating oil of this invention.

The hydrocarbon-derived pour point depressant used herein is a compound selected from (a) copolymers and ethylene and an α-olefin represented by the formula $CH_2=CH-R$ wherein R is an alkyl group having one or more carbon atoms, (b) poly-α-olefins (α-olefin polymers), (c) styene-butadiene copolymers in a hydrogenated form, (d) condensed alkylnaphthalenes and (e) alkylated polystrene.

The above-mentioned copolymers (a) may be illustrated by ethylene·propylene copolymers, ethylene·butene-1 copolymers, ethylene·hexane-1 copolymers and the like, with ethylene·propylene copolymers being particularly preferred. The copolymers (a) which are those of ethylene and the α-olefin of said formula, are essentially amorphous and oil-soluble; they have a number average molecular weight of usually 10,000–200,000, preferably 20,000–70,000 and an ethylene content of usually 30–90 mol%, preferably 40–80 mol%. The term "essentially amorphous" is intended to mean that the copolymers (a) may have some degree of crystallization therein, the crystallization degree being in the range of usually 0–5%, preferably 0–2%. Furthermore, the amorphous copolymers (a) should preferably be those having such a relatively narrow distribution of molecular weight as usually not more than 8, particularly preferably not more than 4.

These ethylene·α-olefin copolymers (a) may be produced by a known specific method. The copolymerization for producing the copolymers (a) is effected by introducing ethylene and α-olefin into a mixture of an organic solvent-soluble, specific and homogenizable Ziegler catalyst and an inert organic solvent at an atmospheric or somewhat elevated pressure and at a low or somewhat elevated temperature. The preferable Ziegler catalysts used herein include coordination catalysts consisting essentially of a vanadium compound represented by the formula $VO(OR)_nX_{3-n}$ wherein X is chlorine, bromine or iodine, R is a hydrocarbon residue having 1–6 carbon atoms and n is an integer of from 0 to 3 and of an organoaluminum halogenide represented by the formula

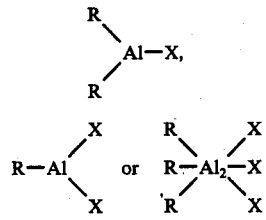

wherein R and X are as defined above. The inert organic solvents used in said polymerization may usually be aliphatic and aromatic hydrocarbons with n-hexane, heptane, toluene, xylene and the like being preferred.

The poly-α-olefins (or α-olefin polymers) (b) used in this invention may be homopolymers of a single α-olefin represented by the formula $CH_2=CH-R$ wherein R is an alkyl group having 7–18 carbon atoms, preferably 8–16 carbon atoms, and having $\leftarrow CH_2 \rightarrow_n$ in which $n$ is an integer of 6 or more. These poly-α-olefins may be produced in the presence of the homogenizable Ziegler catalyst in the same manner as the ethylene ·α-olefin copolymers (a). The poly-α-olefins (b) used herein have a number average molecular weight of usually 10,000–200,000, preferably 20,000–70,000 and is essentially amorphous. In addition, the poly-α-olefins having a narrow distribution of molecular weight may preferably be used.

The styrene-butadiene copolymers in a hydrogenated form (c) used herein are prepared by copolymerizing styrene and butadiene in the presence of an alkyl-alkali metal compound (such as butyl lithium) as the catalyst by using a known method and then hydrogenating the thus-obtained copolymer by using a known method. At this hydrogenation it is desirable that at least 90%, preferably 100%, of the olefinic double bonds in the styrene-butadiene copolymer be hydrogenated. The hydrogenated, styrene-butadiene copolymers (c) may preferably be those wherein the styrene and butadiene units are arranged at random, and they may have an average molecular weight of usually 10,000–200,000, particularly preferably 20,000–70,000. Furthermore, the copolymers (c) used herein contain the styrene units (derived from styrene used) and the butadiene units (derived from butadiene used) in molar ratios of 15–50 : 85–50, preferably 25–40 : 75–60.

The condensed alkylnaphthalenes (d) used herein are condensates of dichloroparaffin and naphthalene, and they are synthesized from these reactants by a known method using anhydrous aluminum trichloride ($AlCl_3$) as a catalyst. The dichloroparaffin is dichloride of paraffin having usually about 15 to 60 carbon atoms. The condensed alkylnaphthalenes used herein have a molecular weight of from about several thousands to one hundred and several ten thousands, usually from 2,000 to 70,000.

The alkylated polystyrenes (e) used herein are obtainable by the use of a known method. They are illustratively obtained by firstly radical polymerizing styrene in the presence of a peroxide initiator such as benzoyl peroxide under such controlled conditions as to produce a polystyrene having a number average molecular weight of 10,000–150,000, preferably 20,000–70,000, and secondly alkylating the thus produced polystyrene with an alkylhalide in the presence of a Friedel-Crafts catalyst to obtain the alkylated polystyrene. The alkylhalides used herein are those represented by the general formula RX wherein R is an alkyl group having 6–20, preferably 8–18, carbon atoms, and X is a halogen atom.

It has surprisingly been found by the present inventors that the pour point of base oil (1) according to this invention will be somewhat lowered if the hydrocarbon-derived pour point depressant alone is added thereto, while if both of the arylalkane (2) and the hydrocarbon-derived pour point depressant (3) are added to the base oil in their respective specified amounts then the base oil will be remarkably lowered in pour point as compared with the addition of either one of said materials (2) and (3). Such remarkable pour point depression is obtained particularly with the base oil having a relatively wide boiling range of about 80° C or more.

It is not entirely known why the addition of both of the arylalkane or arylalkanes and the pour point depressant to the base oil will have a synergistic effect on lowering the oil in pour point, but it is considered that these two materials added will exhibit specific energistic action when the wax contained in the oil is about to crystallize out therein.

The addition of the hydrocarbon-derived pour point depressant in the specific amounts will not have any adverse effect on the thermal stability, electrical properties and the like of the insulating oil consisting of the base oil (1) and the arylalkane or arylalkanes in the respective specified amounts according to this invention.

The addition of the hydrocarbon-derived pour point depressant in amounts of more than 1.0 part will not exhibit any further pour point depressing action, and it will therefore be economically disadvantageous and will, in addition, have adverse effects on the electrical properties, thermal stability and the like, while the addition thereof in amounts of less than 0.001 parts will not exhibit a pour point depressing action.

This invention will be better understood by the following non-limitative Examples.

EXAMPLE 1

A Middle East-produced (mixed base) crude oil was distilled at atmospheric pressure to obtain a bottom oil which was then distilled at a reduced pressure of about 40 mm Hg thus obtaining a distillate having a boiling range of 250°–380° C at atmospheric pressure and a sulphur content of 1.7 wt.%. The distillate so obtained was subjected to extraction with furfural in the ratio by volume of 1.3 between the furfural and the distillate at the extracting temperatures of 75°–90° C thereby to obtain a raffinate having a sulphur content of 0.8 wt.% (desulphurization rate : 56 wt.%). The raffinate so obtained was hydrofined or refined by hydrogenation at a temperature of 300° C and a hydrogen pressure of 40 $Kg/cm^2$ in the presence of a NiO - $MoO_3$ (NiO : 3.0 wt.%, $MoO_3$ : 14.0 wt.%) catalyst carried on alumina and then dewaxed with a benzene-toluene-methyl ethyl ketone (vol. ratio 30 : 25 : 45) mixed solvent (ratio by volume of the solvent to the raffinate : 1.6) at a cooling temperature of −30° C thereby to obtain a base oil (1) indicated by the symbol "A" in Table 1.

70 parts of the base oil symbolized by A was incorporated with 30 parts of heavy alkylbenzenes having a boiling range of about 310°–about 404° C obtained as a by-product when an olefinic material consisting mainly of propylene tetramer was reacted with benzene in the presence of a boron trifluoride catalyst to produce branched chain type alkylbenzenes for use as a detergent, thereby obtaining an electrical insulating oil of this invention indicated by the symbol "B" in Table 1. The properties of this insulating oil B are shown in Table 1.

Table 1

| | Example 1 | | |
|---|---|---|---|
| Properties / Oils tested | Mixed base crude oil-derived base oil A | 70 parts base oil A + 30 parts branched chain type heavy alkylbenzenes B | Branched chain type heavy alkylbenzenes |
| Volume resistivity at 80° C., Ω . cm | $3.8 \times 10^{15}$ | $4.5 \times 10^{15}$ | — |
| Dielectric loss tangent at 80° C.,% | 0.008 | 0.002 | 0.001 |
| JIS Stability (120° C.,75hr) | | | |
| Sludge,% | 0.11 | 0.07 | 0.03 |
| Acid value,mgKOH/g | 0.46 | 0.29 | 7.5 |
| Flash point(PM)° C. | 144 | 152 | — |
| Viscosity at 37.8° C., cSt | 6.35 | 8.93 | — |
| Pour point,° C. | −25 | −27.5 | — |
| Sulphur content, % | 0.24 | 0.21 | 0.00 |
| Total acid value, mgKOH/g | 0.00 | 0.00 | 0.03 |
| Specific dispersion at 25° C. | 110 | 112 | — |
| Copper corrosion (140° C.,19hr) | 2 b | 1 b | — |

Table 1-continued

| Properties | Oils tested | Example 1 Mixed base crude oil-derived base oil A | 70 parts base oil A + 30 parts branched chain type heavy alkyl-benzenes B | Branched chain type heavy alkyl-benzenes |
|---|---|---|---|---|
| (ASTM D 1275) | | (lavender) | (dark orange) | |
| Hydrogen gas absorbency, (Value for 150 minutes) —(Value for 50 minutes) | | 24 | 43 | — |
| Thermal stability (140° C.,30hr) | | | | |
| Sludge, % | | 0.01 | 0.01 | — |
| Total acid value, mgKOH/g | | 0.06 | 0.04 | — |

From this Table it is seen that the insulating oil (B) was an excellent one which was very satisfactory in thermal stability and was improved in inertness to discoloration of copper plate, pour point, hydrogen gas absorbency (corona resistance), electrical properties and the like.

The properties of the heavy alkylbenzenes alone are also shown in Table 1, from which it is seen that the alkylbenzenes alone were very inferior in oxidation stability.

EXAMPLE 2 AND COMPARATIVE EXAMPLE 1

The mixed base crude oil-derived base oil A as shown in Table 1, and a naphthene base crude oil-derived usual mineral oil C obtained by distilling the Venezuela (naphthene base) crude oil at a reduced pressure to obtain a lubricating oil fraction having a boiling range of 270°–440° C at atmospheric pressure and then subjecting the lubricating oil fraction to refinement with sulphuric acid and treatment with clay, were incorporated respectively with the branched type alkylbenzenes shown in Table 1 in the amounts specified in Table 2, thereby obtaining an electrical insulating oil (derived from the mixed base crude oil) and a comparative one (derived from the naphthene base crude oil). The insulating oil and the comparative one so obtained were tested for their thermal stability by thermally degrading 50 ml of each of these oils at a temperature of 130° C for 48 hours by using an apparatus and vessel for JIS (Japanese Industrial Standard) oxidation stability test and then measuring the electrical properties of the tested oils. The results obtained are in Table 2. From Table 2 it is clear that the insulating oil of this invention is very satisfactory in thermal stability as compared with the comparative insulating oil.

Table 2

| Ex. 2 | Amount of mixed base crude oil-derived base oil A used (parts) | Thermal Stability: Amount of alkylbenzene added (parts) | Dielectric loss tangent at 80° C.,% | Volume resistivity at 80° C., $10^{11}$ Ω . cm |
|---|---|---|---|---|
| | 75 | 25 | 0.4 | 90 |
| | 55 | 45 | 0.2 | 150 |
| Comp. ex. 1 | Amount of naphthene base crude oil-derived refined oil C used (parts) | | | |
| | 75 | 25 | 2 | 10 |
| | 55 | 45 | 0.6 | 75 |

EXMAPLE 3 AND COMPARATIVE EXAMPLE 2

In an attempt to evaluate electrical insulating oils for transformers usable at high temperatures, thermally degrading tests were carried out in the co-presence or co-existence of insulating paper. More particularly, the main components (including insulating paper) of such a transformer were placed in a stainless-steel container, 15g of the insulating paper were dried at a vacuum of not higher than 1 mmHg for 4 hours and 800 ml of a test oil were introduced into the container under said vacuum. The container so charged was placed in an air thermostatic vessel and then heated to 150° C while passing air at a rate of 5c.c./min. for 30 days. The test oils were prepared as follows.

(ELECTRICAL INSULATING OIL OF THIS INVENTION)

A Middle East-produced (mixed base) crude oil was distilled at atmospheric pressure to obtain a bottom oil which was then distilled at a reduced pressure thereby obtaining a distillate having a boiling range of 260°–390° C at atmospheric pressure and a sulphur content of 1.9 wt.%. The distillate so obtained was extracted with furfural in the ratio by volume of 1.0 between the furfural and the distillate at a temperature of 60°–90° C to obtain a raffinate which was then hydrofined at a temperature of 300° C, a hydrogen pressure of 40 Kg/cm$^2$ and a LHSV of 1.5 in the presence of a NiO—$MoO_3$ catalyst carried on alumina. The raffinate so hydrofined was dewaxed with a benzene-methyl ethyl ketone (55 : 45) mixed solvent under the same conditions as in Example 1 and successively treated with clay at 70° C for one hour thereby to obtain a base oil (1) having a sulphur content of 0.21 wt.%. This base oil (1) was incorporated with 48 wt.% of the same alkylbenzenes as used in Example 1 to obtain an electrical insulating oil of this invention.

(COMPARATIVE ELECTRICAL INSULATING OIL)

The refined mineral oil derived from the naphthene base crude oil, as obtained in Comparative example 1, was incorporated with 48 wt.% of the same alkylbenzenes as used in Example 1 to obtain a comparative electrical insulating oil.

For comparison purposes, the above mentioned mixed base crude oil-derived base oil (1) alone and said naphthene base crude oil-derived refined mineral oil alone were subjected respectively to the same test as previously mentioned. The results are indicated in Table 3.

From Table 3 it is apparent that the insulating oil of this invention exhibited remarkably excellent results as compared with the comparative insulating oil even in the thermally degrading test carried out in the presence of insulating paper.

Table 3

| | Test oil | Tension of insulating paper after tested: Strength (Kg/15mm) | Strength after test / Strength before test × 100% | Properties of oil after tested or degraded: Dielectric loss tangent | Volume resistivity 80° C., Ω . cm | Apparent sludge |
|---|---|---|---|---|---|---|
| Example 3 | 52 parts of mixed base crude oil-derived base oil + 48 parts of alkylbenzenes | 7.4 | (63) | 2.1 | $12 \times 10^{11}$ | None |
| | Mixed base crude oil-derived base oil alone | 5.9 | (54) | 7.1 | $9 \times 10^{11}$ | Some |
| Comp. 2 | Naphthene base crude oil-derived refined mineral oil alone | 5.3 | (48) | 3.1 | $0.8 \times 10^{11}$ | Large quantities precipitated |
| | 52 parts of naphthene base crude oil-derived refined mineral oil + 48 parts of alkylbenzenes | 5.7 | (53) | 6.9 | $3.9 \times 10^{11}$ | Large quantities precipitated |

EXAMPLE 4 AND COMPARATIVE EXAMPLE 3

Portions of the mixed base crude oil-derived refined mineral A (or base oil A) as indicated in Example 1 were incorporated respectively with specified amounts of an amorphous ethylene-propylene copolymer having a number average molecular weight of 180,000 and a propylene content of 30 mol% and/or with specified amounts of the same alkylbenzene or alkylbenzenes as used in Example 1 thereby to obtain various insulating oils, as indicated in Table 4. The various insulating oils so obtained were tested for their properties, and the results are shown in Table 4.

Table 4 clearly shows that if the ethylene-propylene copolymer alone or the alkylbenzene or alkylbenzenes alone be added to the base oil according to this invention then the additive will somewhat depress the base oil in pour point, while if both of the copolymer and the alkylbenzene or alkylbenzenes are added to said base oil then these materials so added will very remarkably depress the base oil in pour point without degrading it in other properties such as thermal stability and electrical properties. The addition of both of the copolymer and the alkylbenzene or alkylbenzenes will have an extremely greater effect than would be expected with the addition of either one thereof. The insulating oil of this invention having such a depressed pour points as above is suitable for use in frigid regions.

Table 4

| | Comparative example 3 | | | | Example 4 |
|---|---|---|---|---|---|
| Amount of base oil used | 100 parts | 100 parts | 100 parts | 70 parts | 70 parts |
| Amount of copolymer added | | 0.05 parts | 0.1 part | — | 0.05 parts |
| Amount of alkylbenzene added | — | — | — | 30 parts | 30 parts |
| Dielectric Breakdown voltage, kV | | | | | |
| at 25° C | 69 | 64 | 57 | 71 | 70 |
| at −20° C | 58 | 54 | 49 | 59 | 63 |
| at −40° C | 60 | 63 | 51 | 62 | 60 |
| Pour point, ° C | −20 | −27.5 | −35 | −27.5 | −45 |
| Volume resistivity at 80° C., Ω . cm | $3.8 \times 10^{15}$ | $1.4 \times 10^{15}$ | $7.5 \times 10^{14}$ | $8.5 \times 10^{15}$ | $9.1 \times 10^{15}$ |
| Dielectric loss tangent at 80° C., % | 0.008 | 0.011 | 0.017 | 0.002 | 0.002 |
| JIS stability | | | | | |
| Sludge, % | 0.11 | 0.11 | 0.12 | 0.07 | 0.04 |
| Acid value, mgKOH/g | 0.46 | 0.47 | 0.51 | 0.29 | 0.35 |
| Thermal stability (140° C., 30 hr) | | | | | |
| Sludge, % | 0.01 | — | — | 0.00 | 0.00 |
| Total acid value mgKOH/g | 0.06 | | | 0.04 | 0.05 |

EXAMPLE 5

The base oil A as indicated in Table 1 was incorporated with 30 parts of straight chain type alkylbenzenes for a detergent to obtain an insulating oil of this invention, the alkylbenzenes being obtained by hydrogenating kerosene, removing n-paraffin from the hydrogenated kerosene by the use of a molecular sieve, dehydrogenating the paraffin-extracted kerosene in the presence of a platinum catalyst and alkylating the dehydrogenated kerosene with benzene in the presence a HF catalyst. The straight chain type alkylbenzenes are a mixture of alkylbenzenes having $C_{10}$–$C_{13}$ on the side chain or chains, a boiling point of 280°–310° C and a flash point of 136° C.

The properties of the insulating oil of this invention are indicated in Table 5, from which it is seen that the insulating oil was an excellent one which was improved in thermal stability, pour point, hydrogen gas absorbency and electrical properties.

EXAMPLE 6

The base oil A (derived from the mixed base crude oil) as indicated in Table 1 was incorporated with 30 wt.% of branched chain type alkylbenzenes obtained by reacting benzene with an olefinic material consisting mainly of propylene tetramer in a boron trifluoride catalyst, thereby to an electrical insulating oil of this invention. The branched chain alkylbenzenes, which were a mixture of alkylbenzenes having $C_9$–$C_{18}$ side chain or chains, had a boiling point of 281°–325° C and a flash point of 132° C.

Table 5 shows the properties of the insulating oil obtained in Example 6 and also shows that this insulating oil as an excellent one which is improved in thermal stability, pour point, hydrogen gas absorbency and electrical properties.

Table 5

| Properties | Mixed base crude oil-derived base oil A | Example 5: 70 parts of mixed base crude oil-derived base oil A + 30 parts of straight chain type alkylbenzene | Example 6: 70 parts of mixed base crude oil-derived base oil A + 30 parts of of branched chain type alkylbenzene |
|---|---|---|---|
| Volume resistivity at 80° C., Ω . cm | $3.8 \times 10^{15}$ | $6.0 \times 10^{15}$ | $6.0 \times 10^{15}$ |
| Dielectric loss tangent at 80° C., % | 0.008 | 0.004 | 0.002 |
| JIS Stability (120° C., 75hr) | | | |
| Sludge,% | 0.11 | 0.08 | 0.08 |
| Acid Value, mgKOH/g | 0.46 | 0.33 | 0.31 |
| Flash point (PM),° C. | 144 | 148 | 150 |
| Viscosity at 37.8° C., cSt | 6.35 | 5.60 | 6.78 |
| Pour point,° C. | −25 | −27.5 | −32.5 |
| Sulphur content, % | 0.24 | 0.20 | 0.19 |
| Total acid value, mgKOH/g | 0.00 | 0.00 | 0.00 |
| Specific dispersion at 25° C. | 110 | 114 | 115 |
| Copper corrosion (140° C., 19hr) (ASTM D 1275) | 2 b (lavender) | 1 b (dark orange) | 1 b (dark orange) |
| Hydrogen gas absorbency, (Value for 150 minutes) −(Value for 50 minutes) | 24 | 55 | 53 |
| Thermal stability (140° C., 30hr) | | | |
| Sludge, % | 0.01 | 0.01 | 0.02 |
| Total acid value, mgKOH/g | 0.06 | 0.05 | 0.06 |

EXAMPLE 7 AND COMPARATIVE EXAMPLE 4

The electrical insulating oil of this invention as obtained in Example 1 was further incorporated with 0.1 part of a styrene-butadiene copolymer having a number average molecular weight of about 40,000 and a styrene content of 32 mol% wherein about 95% of the double bonds had previously been hydrogenated, thereby to obtain an electrical insulating oil D of this invention. The properties of this insulating oil are shown in Table 6.

For comparison, the electrical insulating oil of this invention as obtained in Example 1 was incorporated with 0.2 parts of polymethacrylate which was a commercially available pour point depressant, thereby to obtain a comparative electrical insulating oil E the properties of which are also shown in Table 6.

In these Example and Comparative example the electrical insulating oil was used in an amount of 100 parts.

From Table 6 it is apparent that the insulating oil D of this invention was an excellent one having a remarkably low pour point as well as satisfactory oxidation stability, emulsification resistance and electrical properties.

In contrast, Table 6 shows that the comparative insulating oil E was not suitable for use as an electrical insulating oil since it had a low pour point but was remarkably inferior in emulsification resistance and electrical properties.

Table 6

| | Electrical insulating oil as obtained in Ex. 1 | Electrical insulating oil D (Ex. 7) | Electrical insulating oil E |
|---|---|---|---|
| Pour point ° C. | −27.5 | −45 | −42.5 |
| Volume resistivity 80° C., Ω . cm | $4.5 \times 10^{15}$ | $4.1 \times 10^{15}$ | $0.71 \times 10^{15}$ |
| Dielectric loss tangent 80° C.,% | 0.002 | 0.005 | 0.018 |
| Oxidation stability (JIS C-2101) | | | |
| Sludge, % | 0.07 | 0.08 | 0.11 |
| Acid value, mgKOH/g | 0.29 | 0.27 | 0;38 |
| Steam emulsion number (JIS K-2517) sec. | 30 | 35 | 1200 or more |
| Thermal stability (ASTM D-1934) Non-use of catalyst | | | |
| Volume resistivity 80° C., Ω . cm | $4.8 \times 10^{3}$ | $4.3 \times 10^{13}$ | $0.66 \times 10^{13}$ |
| Dielectric loss tangent 80° C., % | 0.23 | 0.19 | 0.59 |

What is claimed is:

1. An electrical insulating oil having excellent thermal stability, electrical properties, low pour point and corona resistance, consisting essentially of (1) 50–97 parts by weight of a mineral oil containing not more than 0.35 wt.% of sulphur and being prepared by refining with a solvent for selective dissolution of aromatic compounds a distillate containing at least 80 wt.% of a fraction having a boiling range of 230°–430° C at atmospheric pressure and being obtained by the distillation of a paraffin or mixed base crude oil, said solvent refining also effecting the removal of 30–85 wt.% of the sulphur contained in the distillate, thereby to obtain a raffinate, hydrofining the thus obtained raffinate, and then dewaxing the thus hydrofined raffinate with a solvent for dewaxing, and (2) 3–50 parts by weight of at least one alkylbenzene represented by the formula

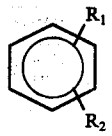

in which $R_1$ and $R_2$ are each hydrogen or a hydrocarbon residue having 1–20 carbon atoms, and the total of carbon atoms contained $R_1$ and $R_2$ is at least 9.

2. An electrical insulating oil according to claim 1, wherein the solvent for the selective dissolution is a member selected from the group consisting of furfural, liquefied sulphur dioxide and phenol, and the solvent for the dewaxing is a member selected from the group consisting of a benzene-toluene-acetone mixed solvent, a benzene-toluene-methyl ethyl ketone mixed solvent and a benzene-methyl ethyl ketone mixed solvent.

3. An electrical insulating oil according to claim 1, wherein the hydrofining is effected at a temperature of about 230°–350° C in the presence of a metal oxide catalyst in which the metal is selected from the group consisting of metals of Groups VI, IB and VIII of the Periodic Table, the catalyst being supported on a carrier.

4. An electrical insulating oil according to claim 14, wherein the electrical insulating oil further contains (3) 0.001–1.0 part by weight of a hydrocarbon-derived pour point depressant selected from the group consisting of:

a. copolymers of ethylene and an α-olefin having the formula $CH_2 = CH - R$ wherein R is an alkyl group having at least one carbon atom, the copolymers being essentially amorphous and oil-soluble and having a number average molecular weight of 10,000–200,000 and an ethylene content of 30–90 mol%, b. homopolymers or copolymers of an α-olefin having the formula $CH_2 = CH - R$ wherein R is an alkyl group having 7–18 carbon atoms and having $(CH_2)_n$ in which $n$ is an integer of at least 6, the homopolymers and copolymers being essentially amorphous and having a number average molecular weight of 10,000–200,000, c. styrene-butadiene copolymers having an average molecular weight of 10,000 to 200,000 and a styrene unit content of 15–50 mol%, in which at least 90% of the olefinic double bonds have been hydrogenated, d. condensed alkylnaphthalenes having an average molecular weight of 2,000–70,000, prepared by the condensation of naphthalene and dichloroparaffin having 15 to 60 carbon atoms and e. alkylated polystyrenes obtained by reacting a polystyrene having a number average molecular weight of 10,000–150,000 with an alkylhalide having the formula RX wherein R is an alkyl group having 6 to 20 carbon atoms and X is a halogen, in the presence of a Friedel-Crafts catalyst.

5. An electrical insulating oil according to claim 4, wherein the copolymers of ethylene and an α-olefin are ethylene. propylene copolymers.

6. An electrical insulating oil according to claim 4, wherein the poly-α-olefins are ethylene.butene-1copolymers and ethylene.hexane-1 copolymers.

7. An electrical insulating oil according to claim 4, wherein the styrene-butadiene copolymers in a hydrogenated form are those having an average molecular weight of 10,000–200,000 and a molar ratio of 15–50 between the styrene units and the butadiene units.

8. An electrical insulating oil according to claim 4, wherein the condensed alkylnaphthalenes are condensates of dichloroparaffin and naphthalene.

9. An electrical insulating oil according to claim 4, wherein the solvent for the selective dissolution for aromatic compounds is a member selected from the group consisting of furfural, liquefied sulphur dioxide and phenol, and the solvent for the dewaxing is a member selected from the group consisting of a benzene-toluene-acetone mixed solvent a benzene-toluene-methyl ethyl ketone mixed solvent and a benzene-methyl ethyl ketone mixed solvent.

10. An electrical insulating oil according to claim 4, wherein the hydrofining is effected at a temperature of about 230°–350° C in the presence of a metal oxide catalyst in which the metal is selected from the group consisting of metals of Groups VI, IB and VIII of the Periodic Table, the catalyst being supported on a carrier.

11. An electrical insulating oil having excellent thermal stability, electrical properties, low pour point and corona resistance, consisting essentially of (1) 50–97 parts by weight of a mineral oil containing not more than 0.35 wt.% of sulphur and being prepared by refining with a solvent for selective dissolution of aromatic compounds a distillate containing at least 80 wt.% of a fraction having a boiling range pf 230°–430° C at atmospheric pressure and being obtained by the distillation of a paraffin or mixed base crude oil, said solvent refining also effecting the removal of 30–85 wt.% of the sulphur contained in the distillate, thereby to obtain a raffinate, hydrofining the thus obtained raffinate, and then dewaxing the thus hydrofined raffinate with a solvent for dewaxing, (2) 3–50 parts by weight of at least one alkylbenzene represented by formula

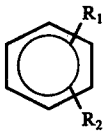

in which $R_1$ and $R_2$ are each hydrogen or a hydrocarbon residue having 1–20 carbon atoms, and the total of carbom atoms contained in $R_1$ and $R_2$ is at least 9, and (3) 0.001–1.0 part by weight of a hydrocarbon-derived pour point depressant consisting of copolymers of ethylene and an α-olefin having the formula $CH_2 = CH - R$ wherein R is an alkyl group having at least one carbon atom, the copolymers being essentially amorphous and oil-soluble and having a number average molecular weight of 10,000–200,000 and an ethylene content of 30–90 mol%.

12. An electrical insulating oil having excellent thermal stability, electrical properties, low pour point and corona resistance, consisting essentially of (1) 50–97 parts by weight of a mineral oil containing not more than 0.35 wt.% of sulphur and being prepared by refining with a solvent for selective dissolution of aromatic compounds a distillate containing at least 80 wt.% of a fraction having a boiling range of 230°–430° C at atmospheric pressure and being obtained by the distillation of a paraffin or mixed base crude oil, said solvent refining also effecting the removal of 30–85 wt.% of the sulphur contained in the distillate, thereby to obtain raffinate, hydrofining the thus obtained raffinate, and then dewaxing the thus hydrofined raffinate with a solvent for dewaxing, (2) 3–50 parts by weight of at least one alkylbenzene represented by the formula

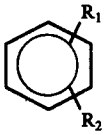

in which $R_1$ and $R_2$ are each hydrogen or a hydrocarbon residue having 1–20 carbon atoms, and the total of carbon atoms contained in $R_1$ and $R_2$ is at least 9, and (3) 0.001–1.0 part by weight of a hydrocarbon-derived pour point depressant consisting of styrene-butadiene copolyers having an average molecular weight of 10,000 to 200,000 and a styrene unit content of 15–50 mol%, in which at least 90% of the olefinic double bonds have been hydrogenated.

* * * * *